US007604364B2

(12) United States Patent
Walker et al.

(10) Patent No.: US 7,604,364 B2
(45) Date of Patent: Oct. 20, 2009

(54) LIGHTING FIXTURE

(75) Inventors: Victor L. Walker, Murrieta, CA (US); Phil Timothy Pflueger, Escondido, CA (US)

(73) Assignee: Dimension One Spus, Vista, CA (US)

( * ) Notice: Subject to any disclaimer, the term of this patent is extended or adjusted under 35 U.S.C. 154(b) by 27 days.

(21) Appl. No.: 11/676,972

(22) Filed: Feb. 20, 2007

(65) Prior Publication Data

US 2008/0198575 A1 Aug. 21, 2008

(51) Int. Cl.
*F21V 33/00* (2006.01)

(52) U.S. Cl. ..... 362/96; 362/101; 362/362

(58) Field of Classification Search ..... 362/362, 362/101, 147, 96
See application file for complete search history.

(56) References Cited

U.S. PATENT DOCUMENTS 6,053,623 A * 4/2000 Jones et al. ..... 362/310
6,361,186 B1 * 3/2002 Slayden ..... 362/249
7,125,146 B2 * 10/2006 Willis et al. ..... 362/267
7,357,525 B2 * 4/2008 Doyle ..... 362/101
2004/0047145 A1 * 3/2004 Koren ..... 362/101
2006/0002105 A1 * 1/2006 Hinojosa ..... 362/101
2006/0262529 A1 * 11/2006 Hornsby et al. ..... 362/231
2008/0094821 A1 * 4/2008 Vogtner ..... 362/101
2008/0112157 A1 * 5/2008 Boothe et al. ..... 362/101
2008/0239706 A1 * 10/2008 Longoria et al. ..... 362/101

* cited by examiner

*Primary Examiner*—Ali Alavi
*Assistant Examiner*—Evan Dzierzynski
(74) *Attorney, Agent, or Firm*—Lewis Kahn & Fitzwilliam LLP; Timothy W. Fitzwilliam

(57) ABSTRACT

A light fixture for a water containment vessel or other application has a fixture configured to receive a light assembly at one end and a decorative top at the other end. The fixture can be configured to be inserted into a water containment vessel wall and to accept interchangeable decorative top pieces, thereby allowing alteration or customization of the lighting provided.

23 Claims, 10 Drawing Sheets

LIGHTING FIXTURE

TECHNICAL FIELD

The present invention relates generally to water containment vessel lighting, and more particularly, some embodiments relate to lighting elements for pools, spas, tubs, water features, fountains and other water containment vessels.

DESCRIPTION OF THE RELATED ART

Hot tubs, spas and jetted bath tubs (spas) are generally constructed in a variety of materials and methods. Initially, stand-alone spas were made by pool contractors and such by digging a hole in the ground and installing rebar, plumbing, electrical components and other items. The rebar was then covered with cement, gunite or other similar materials. A variety of interior finishes, including plaster, tile, and pebble coat finishes are available. The materials are very expensive and produce a product that is generally immobile. Some spas, including those integrated with swimming pools are still constructed this way.

In the early 1970s the portable hot tub or spa came into being. The first examples were made from wood which was shaped and fashioned into a circle and surrounded by bands of steel to maintain the circular shape. The installer would than wet the wood for some time, allowing the wood to expand to seal the joint to prevent leaks. At this time, due to the construction method, there were limited choices for consumers in regards to the lighting options of these hot tubs. Most designs only offered one incandescent light in the bottom of the spa, mainly for safety reasons. These first spas were improved upon by the addition of seating and through-wall jets that would provide massage action using water circulated through a pump.

Newer spas with multiple jets became popular and as a result produced a demand for improved methods of manufacturing spas. Such methods use gel-coat and fiberglass to create a vessel to hold the water which in turn allowed for the addition of more hydrotherapy jets. These new spas also were enclosed in a housing, or skirt, which made it possible to leave the spa sitting above ground.

"Portable" spas evolved with the advent of single sheet thermal forming manufacturing. This method uses a single sheet of plastic which is formed into a female mold, removed from the mold, and reinforced using a variety of different materials such as high density polyurethane, polyester-based resin, fiberglass, or epoxy.

As the industry has continued to grow, spa features have also continued to evolve. In the pool and spa industry, for example, lighting has taken on an increasingly significant role. Due to the limited availability of electrical sources, lighting systems perform multiple roles at one time. Therefore it can be important to outfit pools and spas with lighting systems that are reliable, safe and interchangeable. Many times the competing functions that lighting accomplished fall into less important categories when a user considers how lighting can be used to enhance a pool or spa experience.

Early hot tubs used incandescent lights to illuminate the hot tub for safety. These early incandescent lights did not allow for convenient color changing and the bulb life was short. The lights used plastic colored lenses to change the light color (e.g. red or blue) but were not user friendly and were difficult to store and install. The incandescent lights used colored lens covers which were mounted to the light in an area located underwater. Because of the light location, removing and exchanging the lens was difficult and time consuming. The lenses were also only available in a few colors so consumers had few aesthetic options to choose from. Furthermore, the lights did not offer any accent or ambiance lighting characteristics and were mainly designed to light the bottom foot area of the hot tub for safety reasons.

Soon thereafter fiber optic lighting became popular and consumers had more colors and features to choose from. New light features included, but were not limited to, bartop lighting and control lighting. Fiber Optic systems also allowed for some accent lighting features in the spas, but theses features were static or constant and were not customizable. Fiber optic lights are used in "fixed" through wall fittings that do not allow the end user to customize the light. These systems were garish and static as the light housing was simply a hard, clear, polished acrylic fitting. They provided harsh points of light, rather than a soft or diffused look. The clear acrylic fittings are considered inferior because inevitability they harden, crack and turn yellow over time, degrading the look of the light system. More importantly the aforementioned shortcomings also become potential leak points. The acrylic fittings typically stand apart from spa designs and do not appear as an integrated feature. They distract from the overall design theme because the parts are very utilitarian in nature. The fiber optic systems were also very labor intensive to install/manufacturer and very difficult to fix once the product is placed in its final location. Fiber Optic systems also do not support any "after market" opportunities for the manufacturer.

Due to the continuing rise in popularity of lighting in water containment vessels (an particularly in spas), accent lighting continues to evolve. The newest trend in lighting appeared with the advent of light emitting diodes (LED lights). LED lights are durable, low cost, high-illumination, high-efficiency lights that are easily adaptable to the spa industry. LED lights have a major cost advantage over fiber optic systems and are also more reliable. However, LED lighting systems continue to be installed at the manufacturer, and remain static after installation. Current lighting systems have no opportunity to provide an end user with a means for upgrading or customizing the lighting. These often use the same lenses as fiber optic lighting and exhibit some of the same shortcomings. Typically, LED lighting systems on the market today are used as the main spa light and not as accent lighting. Current LED lighting systems, whether accent in nature or otherwise, are also "static." They do not facilitate user interaction and lack the ability to be arranged into unique or different configurations. Additionally, the light systems are also not designed as modules. Also, these and other conventional lighting systems are thought by some to be unattractive when not turned on.

BRIEF SUMMARY OF EMBODIMENTS OF THE INVENTION

Briefly, the present invention is a module based lighting assembly. The assembly utilizes a light source, a receptacle, and an interchangeable receptacle top. In one embodiment, the receptacle serves as a light emitter, as well as a water resistant through-wall fitting capable of receiving interchangeable receptacle tops and light sources.

Modular lighting systems, LED or otherwise, can be implemented in such a manner as to enable the manufacturer and end user to easily upgrade and change the systems. Modular systems can also be implemented to provide a user friendly, long life lighting system that can produce a multiplicity of accent lighting. Additionally, modular systems can provide an efficient modular assembly that allows for low cost maintenance and aftermarket opportunities.

In one particular example, the module based lighting assembly can be implemented to provide light and shadow combinations to present a pleasing optical effect. Lighting effects may be easily modified by an end user by selecting different receptacle tops. Using different tops can, in turn, produce more or less light in addition to different patterns of projected shadows. As would be apparent to one of ordinary skill in the art after reading this description, the ability to change lighting tops can also provide the user with the ability to customize the appearance of the lighting feature to his or her preferences.

Advantageously, the ability to modify the lighting effects can provide an end user the ability to control the mood of interaction and produce a desired experience. Additionally, the modular nature of the invention allows the lights to be exchanged or replaced quickly and without costly materials.

According to various embodiments of the invention a light fixture for a pool, spa, tub or other water containment vessel includes a stem having a first end and a second end and sized to fit through an aperture in a wall of the pool, spa or other item. A base is provided extending from the first end of the stem and having a socket therein sized to accept a light source, wherein at least a portion of a the base proximate the stem has a diameter larger than that of the stem. A flange extends from the second end of the stem and having a mounting fixture configured to accept a light top. In one embodiment, the base is configured to be inserted in an aperture of the pool, spa or other item, such that a groove created at the stem between the base and the flange engages the wall of the pool, spa or other item, and wherein a light emitted from a light source disposed in the socket is diffused by the flange. The light fixture can be constructed of silicone or other like material.

The light fixture can include a light top configured to be removably mounted to the mounting fixture. The light top can have a plurality of apertures arranged in a pattern. The light top can be made to include a pavilion having plurality of apertures arranged in a pattern and a mounting apparatus disposed thereon configured to mate with the mounting fixture. The light top can be made of material that is completely opaque, or made with a material having a desired level of opacity.

In accordance with another embodiment of the invention, a light assembly for a water containment vessel includes a removable light assembly having a light source at a proximal end and an electrical connector at a distal end. It also includes a fixture having at least a stem having a first end and a second end and sized to fit through an aperture in a wall of a water containment vessel; a base extending from the first end of the stem and having a socket therein sized to accept the lead assembly, wherein at least a portion of a the base proximate the stem has a diameter larger than that of the stem; and a flange extending from the second end of the stem and having a mounting fixture. A light top having a mounting piece configured to removably mate with the mounting fixture of the flange can also be included. The light top can be made of material that is completely opaque, or made with a material having a desired level of opacity.

In one embodiment, the base is configured to be inserted in an aperture of a water containment vessel, such that a groove created at the stem between the base and the flange engages the wall of the water containment vessel, and wherein a light emitted from the light source disposed in the socket is diffused by the flange. In one embodiment, the light top comprises a plurality of apertures arranged in a pattern. In another embodiment, the light top comprises a pavilion having plurality of apertures arranged in a pattern and a mounting apparatus disposed thereon configured to mate with the mounting fixture.

In accordance with yet another embodiment of the invention, a vessel is provided that includes at least one wall having an interior surface and an exterior surface and an aperture in the wall of the vessel. A fixture is mounted in aperture and includes a stem, extending through the aperture and having a first end and a second end; a base extending from the first end of the stem, having a socket therein sized to accept a light source; and a flange extending from the second end of the stem and having a mounting fixture. A light top removably secured to the flange at the mounting fixture can also be provided. The light top can be made of material that is completely opaque, or made with a material having a desired level of opacity.

In one embodiment, the base is configured to be inserted in an aperture of the vessel, such that a groove created at the stem between the base and the flange engages the wall of the water containment vessel, and wherein a light emitted from the light source disposed in the socket is diffused by the flange. In one embodiment, the light top includes a plurality of apertures arranged in a pattern. In another embodiment, the light top includes a pavilion having plurality of apertures arranged in a pattern and a mounting apparatus disposed thereon configured to mate with the mounting fixture.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a flexible lighting system and method for water containment vessels such as pools, spas, tubs, fountains and others. Lighting systems can be used to accomplish many functions. For example, lighting can be used as a means to ensure safety, to display messages or provide an ambiance for an experience. Lighting systems can also be employed to illuminate symbols or project a company's logo. As such, lighting can play an important role in settings where water is present. Furthermore, such lighting systems are preferably resistant to water damage, while being serviceable.

Before describing the invention in detail, it is useful to describe an example environment with which the invention can be implemented. One such example is that of a pool, spa or other water containment vessel. From time-to-time, the present invention is described herein in terms of application in this example environment of a spa. Description in terms of this environment is provided to allow the various features and embodiments of the invention to be portrayed in the context of an exemplary application. After reading this description, it will become apparent to one of ordinary skill in the art how the invention can be implemented in different and alternative environments, including other water containment vessels and other applications whether or not related to water containment vessels.

Figure 1:
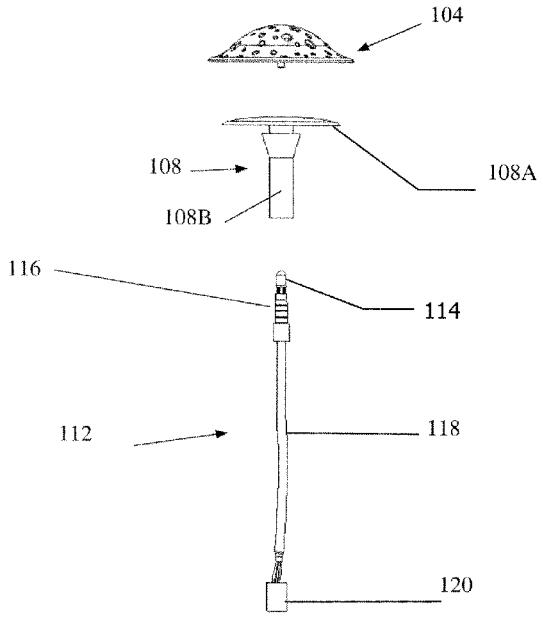
FIG. 1 is a diagram illustrating an exploded view of a light fixture in accordance with one embodiment of the invention.

FIG. 1 is a diagram illustrating an exploded view of a light assembly in accordance with one embodiment of the invention. Referring now to FIG. 1, the light assembly includes a top piece 104, a fixture body 108 and a light assembly 112. In the illustrated embodiment, light assembly 112 includes an LED, light bulb, or other light source 114, a mounting bracket 116, a lead 118, and a modular connector 120. The light assembly is configured such that fixture 108 can be mounted in the wall or other surface of the spa, such that the top surface 108A is exposed on the interior of the spa, and the lower portion 108B extends on the exterior side of the spa wall. In one embodiment, fixture 108 is configured as an emitter that can emit light from the LED or other bulb 114 positioned therein. In one embodiment, fixture 108 (sometimes referred to as emitter 108), also serves as a diffuser of the light source.

Light assembly 112, in one embodiment, can be removably mounted in emitter 108 such that when illuminated, the light source is diffused by emitter 108 to present a diffuse source of light to the interior of the spa. Preferably, assembly 112 is easily removed and replaced from fixture 108 to allow different lighting options to be chosen and configured. In one embodiment, top piece 104 is removably mounted to fixture 108 such that various tops are with various patterns or colors, and can be easily mounted on emitter 108 to provided the desired effect. In another embodiment, multiple top pieces 104 are stackable upon one another so that additional lighting/shadow effects can be created. Also, tops 104 can be rotatable to provide further customization. In yet another embodiment, tops 104 can be made from materials having different levels of opacity to provide further customization options. Additionally, lenses or other devices can be used to allow the top 104 to project a desired pattern of light onto the opposite surface of the spa. However, lenses may not be required, as various apertures in the light top will also project or allow light to pass from the emitter.

Although illustrated as a single piece unit fabricated from material such as silicone, emitter 108 can also be made from separate components. For example, in an alternative embodiment, emitter 108 can have portions 108A, 108B manufactures as separate components and assembled together to form emitter 108. As a further example, top surface 108A might be made of Silicone or other like material to provide diffuse lighting and a sealing character to the aperture in which the light is placed. Base 108B could be made from plastic or other like material mated to top portion 108A. Base 108B can also have a threaded portion for threaded installation into a like threaded aperture.

Figure 2:
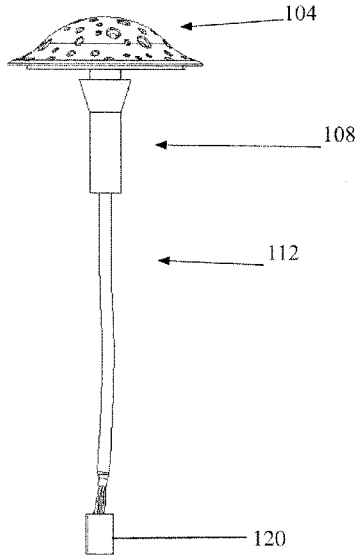
FIG. 2 is a diagram illustrating a collapsed view of a light fixture in accordance with one embodiment of the invention.

FIG. 2 is a diagram illustrating a collapsed view of the light assembly in accordance with one embodiment of the invention. Referring now to FIG. 2, illustrated are top piece 104 mounted in a proximal end of emitter 108, as well as light assembly 112 mounted in the distal end of emitter 108. In one embodiment, the lighting system can be configured such that lead assemblies 112 are easily removed and replaced in emitter 108. As such, bulb replacement can be easily performed to either replace damaged bulbs or to change bulb colors for a desired effect.

Figure 3:
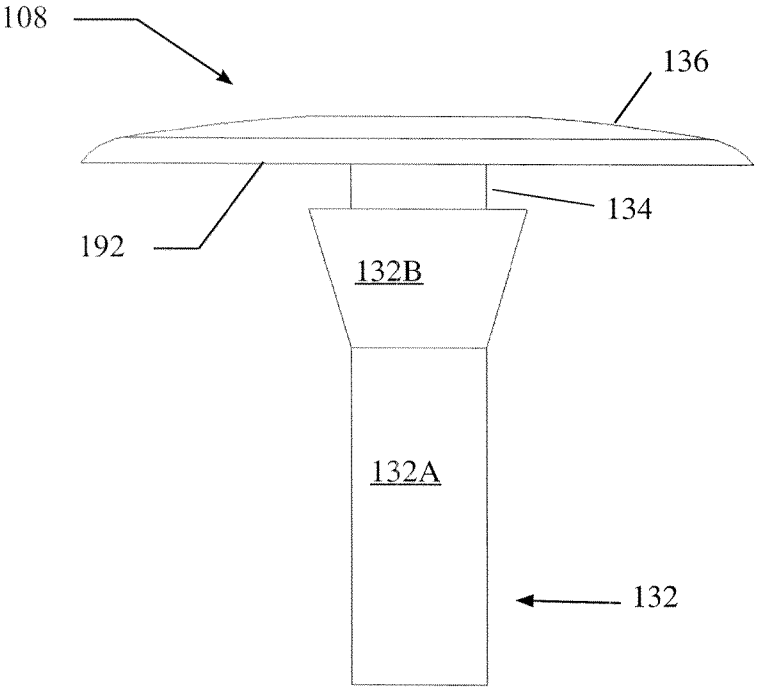
FIG. 3 is a diagram illustrating a side view of an emitter in accordance with one embodiment of the invention.

FIG. 3 is a diagram illustrating a side view of emitter 108 in accordance with one embodiment of the invention. Referring now to FIG. 3, emitter 108 in this embodiment includes an emitter base 132 and an emitter flange 136. A stem, preferably of smaller diameter than base 132 and flange 136 extends therebetween, creating a groove 134. As a through-wall fitting, emitter 108 can be configured such that the emitter base 132 can be inserted into through hole, opening or other aperture in the spa wall. In the illustrated embodiment, emitter base 132 includes a cylindrical section 132A and a conical section 132B, although other configurations are possible. The provision of a conical section 132B can be configured to allow easy insertion of stem 132 into a through hole on the sidewall (or other surface) of the spa, while the larger diameter surface of conical section 132B can provide resistance from removal of emitter 108. Additionally, a larger diameter surface of section 132B can provide a tight fit of emitter 108 and flange 136 against the surface of the spa, thus facilitating a water-tight fit. Sizing of groove 134 can also be selected to ensure a water-tight fit.

Figure 4:
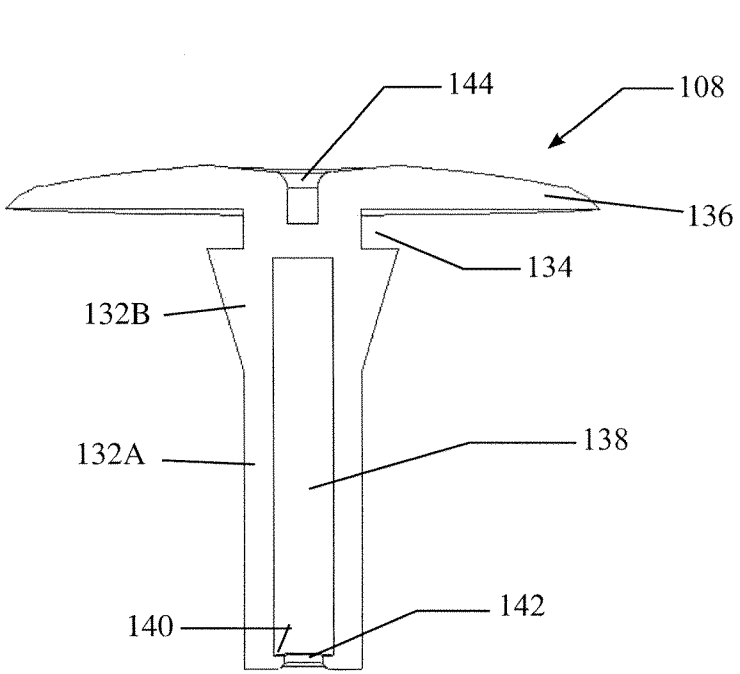
FIG. 4 is a diagram illustrating a section view of an emitter in accordance with one embodiment of the invention.

FIG. 4 is a diagram illustrating a section view of emitter 108 in accordance with one embodiment of the invention. Referring now to FIG. 4, the section view also illustrates an emitter base 132 having a substantially cylindrical portion 132A and a substantially conical portion 132B, thus creating, in conjunction with emitter flange 136, a mounting groove 134. The section view also illustrates a recess that forms a mounting point 144 that can be used as a mounting point for one or more top pieces 104. In the illustrated embodiment, recess 144 is a generally cylindrical hole in emitter 108 that can accept a corresponding mounting post from a top piece 104. As would be apparent to one of ordinary skill in the art after reading this description, alternative mounting point shapes and sizes can be provided, and configurations can be implemented wherein a plurality of recesses or mounting points are provided for top piece 104. Preferably, in one embodiment, the configuration used to allow a top piece 104 to be installed with an emitter 108 is implemented to provide a stable fitting but to also allow relatively easy removal and replacement of the top piece 104. As such, ease of reconfiguration can be provided.

Also illustrated in this section view of FIG. 4 is a socket 138 that is used to accommodate a light assembly 112. In this embodiment, light assembly 112 can be inserted into socket 138 such that light from the LED 114 or other light source can be coupled to and emitted by emitter 108. In the illustrated embodiment, the interior portion of emitter base 132 includes an undercut 140 to hold light assembly 112 firmly in place within socket 138. Additionally, an opening 142 can be provided to allow insertion of light assembly 112 into socket 138. In embodiments where the emitter is manufactured with relatively flexible materials, undercut 140 can provide a relatively stable mounting for light assembly 112 yet allow for removal and replacement of light assembly 112 as desired.

In one embodiment, emitter 108 is manufactured using silicone, rubber, or other like material. Preferably, the material utilized provides sufficient pliability to allow emitter stem 132 to be inserted into a through hole in the spa while providing an adequate seal by emitter flange 136. In one embodiment, emitter 108 is fashioned using a single piece of material that is molded, cast, or otherwise formed into the desired shape. As would be appreciated however emitters can be formed with multiple pieces of material as well.

Figure 5:
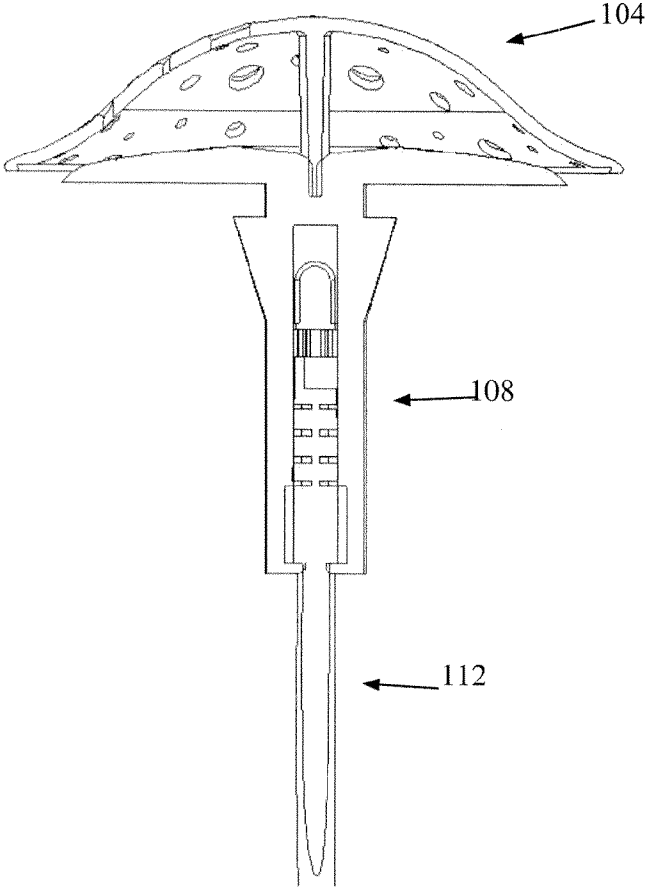
FIG. 5 is a diagram illustrating a section view of a light fixture in accordance with one embodiment of the invention.

FIG. 5 is a diagram illustrating a section view of a light assembly in accordance with one embodiment of the invention. Referring now to FIG. 5, illustrated are an emitter 108 with a light assembly 112 inserted in socket 138 at the distal end and a top piece 104 inserted in mounting fixture 144 (illustrated as a recess) at the proximal end.

Figure 6:
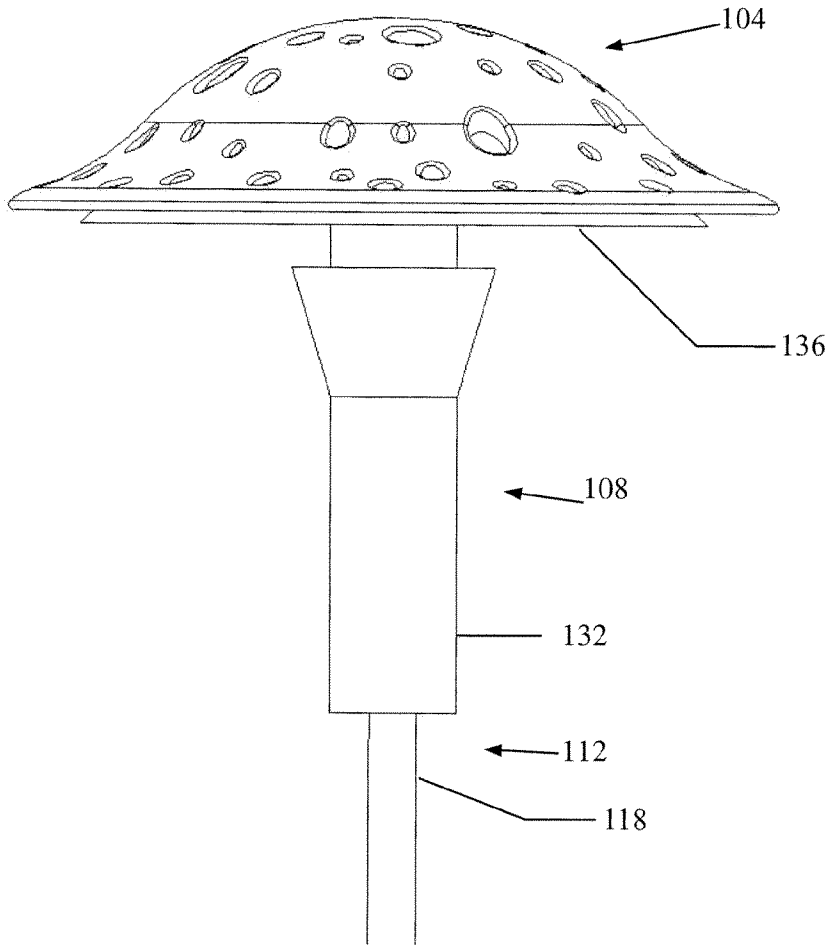
FIG. 6 is a diagram illustrating an external view of a light fixture in accordance with one embodiment of the invention.

FIG. 6 is a diagram illustrating an external view of a complete light assembly in accordance with one embodiment of the invention. As illustrated, lead 118 from light assembly 112 is illustrated as extending from emitter stem 132. Also illustrated is one example of a top piece 104 mounted on emitter flange 136.

Figure 7:
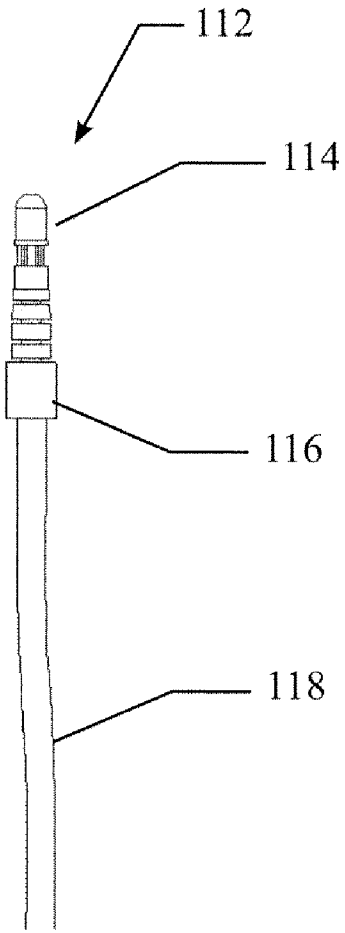
FIG. 7 is a diagram illustrating a close-up view of a light assembly in accordance with one embodiment of the invention.

FIG. 7 is a diagram illustrating a close-up view of a light assembly 112 in accordance with one embodiment of the invention. Referring now to FIG. 7, the example light assembly 112 includes a light source (such as, for example, an LED) 114, a mounting fixture 116 and a lead 118. Lead 118 preferably includes a pair of insulated wires to provide the appropriate electrical current to illuminate light source 114, lead 118 is preferably a flexible lead such that it can be routed to various portions of the spa or other environment where the light source is desired. Mounting portion 116 in the illustrated embodiment includes a portion that has a diameter greater than the diameter of lead 118. As such, upon installation into socket 138, this section of mounting portion 116 can rest against undercut 140 for a relatively snug fit. The length of mounting portion 116 and light source 114 can be provided such that the light source is at the desired position within socket 138 such that its light can be properly diffused or projected by emitter 108. The interface between mounting element 116 and undercut 140 is illustrated in the cross section view discussed above with reference to FIG. 5.

Figure 9:
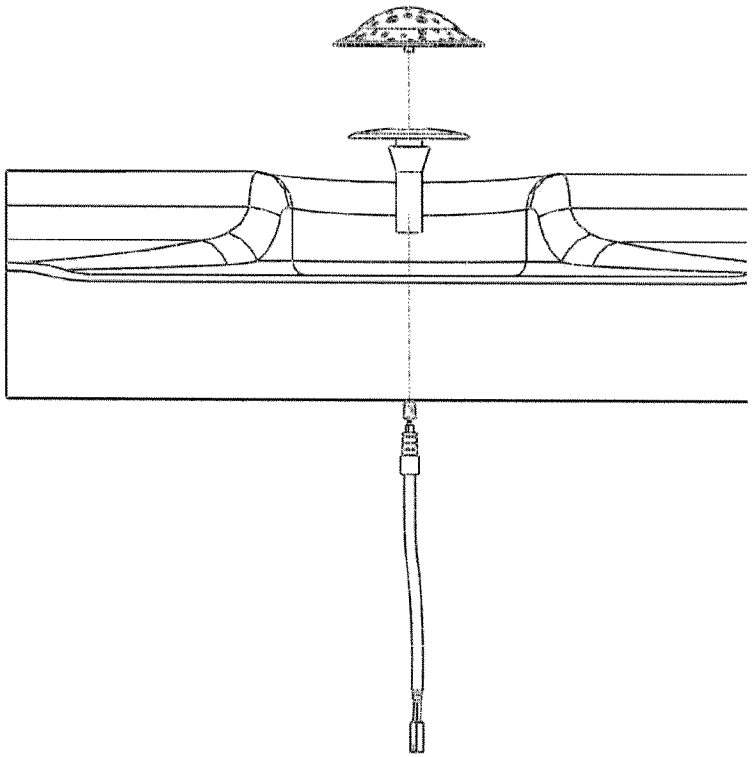
FIG. 9 is a diagram illustrating another view of an exploded light fixture similar to that described with respect to FIG. 8.
Figure 8:
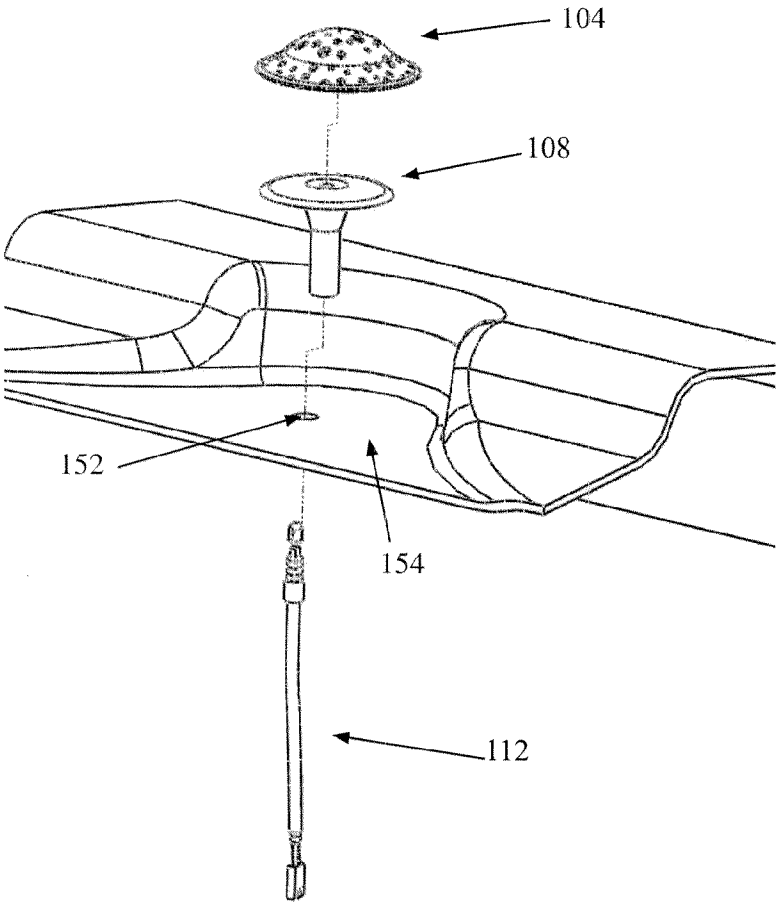
FIG. 8 is a diagram illustrating an exploded view of a light fixture with the mounting surface into which the assembly is to be installed in accordance with one embodiment of the invention.

Having thus described an example assembly in accordance with one or more embodiments, the installation of this assembly is now described. FIG. 8 is a diagram illustrating an exploded view of a light assembly with the mounting surface into which the assembly is to be installed. In one embodiment, the mounting surface can include any surface of a pool, spa, fountain, tub or other water containment vessel as may be desired. The surface of the desired feature can be any surface such as, for example, a side wall, a floor, a seating surface, a bench, a top surface, or other surface or location where a light fixture is desired. Referring now to FIG. 8, illustrated are a through hole 152 and a mounting surface 154 into which the light assembly is installed. Although a circular configuration is illustrated, other shapes, sizes and configurations of emitters and mounting holes are permissible. As illustrated, the base of emitter 108 is inserted into through hole 152, and, in one embodiment, can be configured as a self-sealing emitter to provide a leak-free seal. Underwater or high pressure applications may utilize additional sealants, threaded assemblies, or other mechanisms to provided a stronger seal. Light assembly 112 can be installed in socket 138 of emitter 108, and a desired top piece 104 installed in recess 144. FIG. 9 is a diagram illustrating another view of an exploded light assembly similar to that described with respect to FIG. 8.

Figure 11:
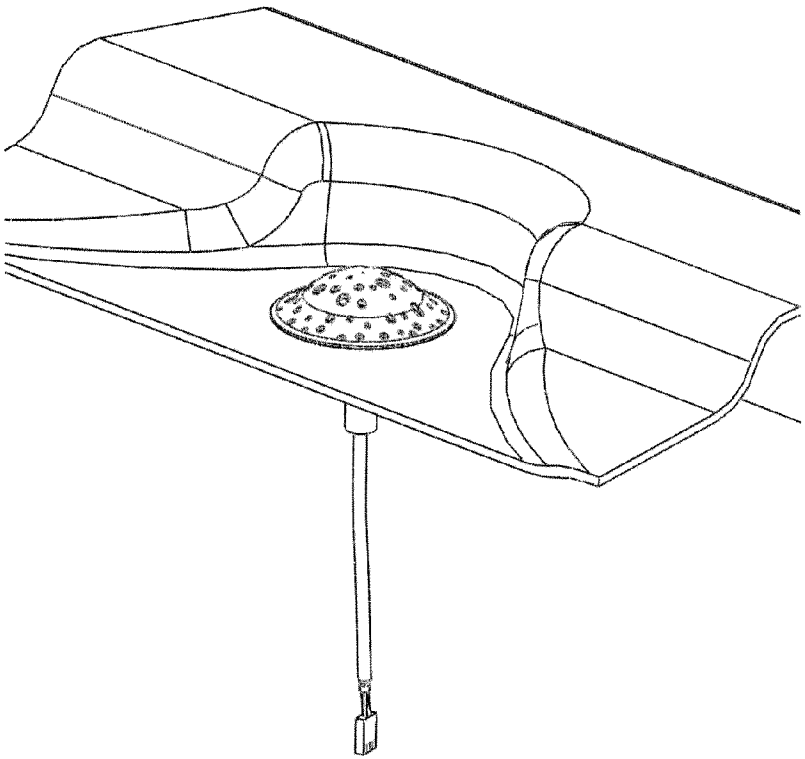
FIG. 11 is a diagram illustrating a view of the light fixture installed on the mounting surface in accordance with one embodiment of the invention.
Figure 10:
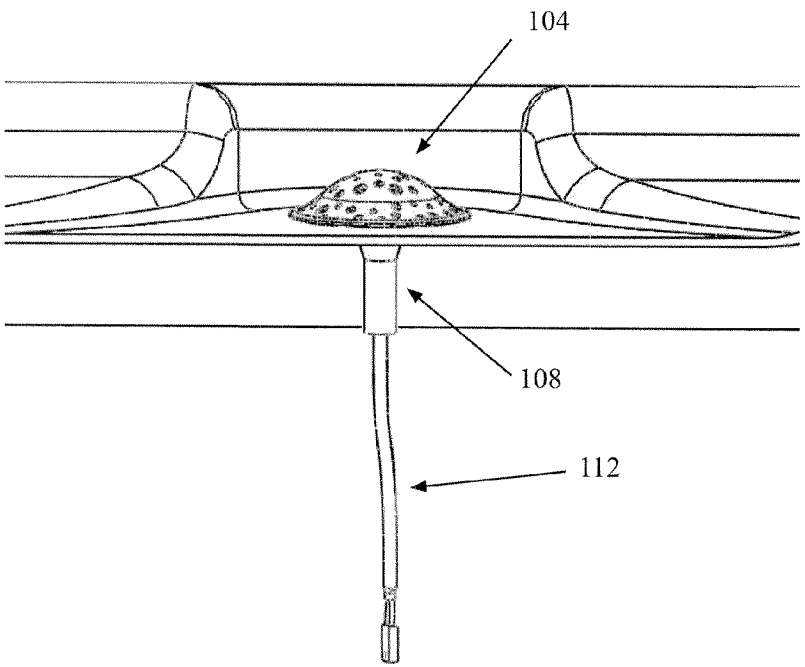
FIG. 10 is a diagram illustrating a view of the light assembly installed on the mounting surface in accordance with one embodiment of the invention.

FIGS. 10 and 11 illustrate views of the light assembly installed on the mounting surface in accordance with one embodiment of the invention. As illustrated, light assembly 112 is inserted into emitter 108 which is inserted into through hole 152 (illustrated in FIGS. 8 and 9). A top piece 104 is mounted to emitter 108 to provide the desire lighting effect.

Figure 12:
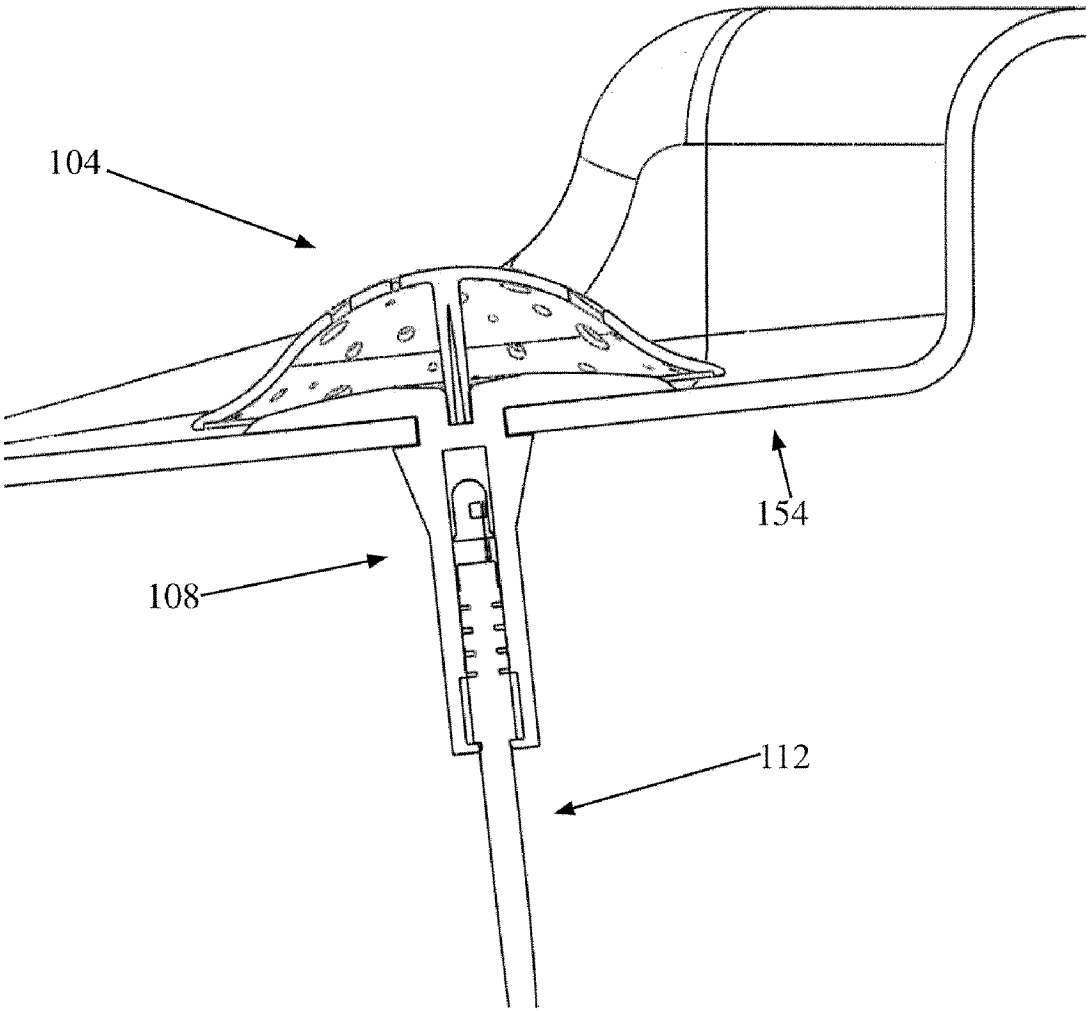
FIG. 12 is a diagram illustrating a section view of the light fixture installed on a mounting surface in accordance with one embodiment of the invention.

FIG. 12 is a diagram illustrating a section view of the light assembly installed on a mounting surface in accordance with one embodiment of the invention. Referring now to FIG. 12, emitter 108 is illustrated as being inserted through the through hole of mounting surface 154. As illustrated in FIG. 12, mounting surface 154 engages with mounting groove 134. Preferably, mounting groove 134 is dimensioned such that a tight fit is provided between emitter 108 and mounting surface 154 such that seepage of water through the through hole 152 is minimized or eliminated. As discussed above, pliant sealable materials such as, for example, silicone can be used to ensure a good seal. In some embodiments, additional sealants can be utilized. The embodiment illustrated in FIG. 12 also depicts a light assembly 112 and top piece 104 inserted into emitter 108, thus depicting a complete assembly.

As discussed above, in one embodiment, the emitter is manufactured using silicone or other like materials. A silicone fitting generally provides a better seal than traditional hard plastic designs and also stays soft and pliable during its life span. Due to the nature of silicone, the light emitter provides a soft, non-harsh lighting effect. The silicone can be implemented such that the lighting effect does not change over time and such that it looks more elegant than prior accent lighting solution.

Providing a fitting to allow easy installation and replacement of various tops, can allow customization of the lighting effect. Preferably, in one embodiment, the top piece 104 is configured to be easily installed, removed or changed without the use of special tools or equipment. As such, the post (or posts) of top 104 and corresponding recess 144 are sized to provide a friction fit sufficient to hold the top firmly in place while allowing ease of replacement. Alternatively, snap-fit, threaded or other easily interchangeable mounting brackets can be provided. In such embodiments, the design can create an upgradeable or interchangeable design platforms. As described in greater detail below, different designs can be utilized allowing manufacturing flexibility as well as creating after market opportunities for consumer upgrade or customization. Preferably, the top 104 is a low profile design with a very small footprint. Utilizing a small size makes them easy to integrate into existing products as well as keeping manufacturing costs to a minimum, although the light assembly in one embodiment can be manufactured into any desired shape and size. As illustrated in FIGS. 8 through 11, in one embodiment the light can be built in to small recesses in a bar top area of conventional spa designs. The recesses can be used to create light and shadow effects of the tops as well as to provide clearance for the design.

In one embodiment, the silicone emitters can be implemented to provide a very even light tone without revealing evidence of the light source. Silicone or other like material can be used to create a soft, glow. Tops 104 can act as a lamp shade over the emitter and thus be used to create or control the amount of light and shadow. The possibilities for patterns for top 104 are infinite as are the shapes and sizes that can be provided to allow along line of custom or off-the-shelf products. A few examples of designs that can be implemented with tops 104 are now described. FIGS. 13 through 16 illustrate examples of patterns that can be provided on top pieces 104 as well as example shapes of top pieces. As noted above, top pieces 104 can be completely opaque or made with a material having a desired level of opacity. Top pieces 104 can also be made in different colors to provide additional design options. Top pieces 104 can also have holes, cutouts or other apertures to allow light to pass from the emitter to the water containment vessel. Additionally, lenses or other optical elements (clear, colored or otherwise) can be provided in the apertures for desired effects.

Figure 13:
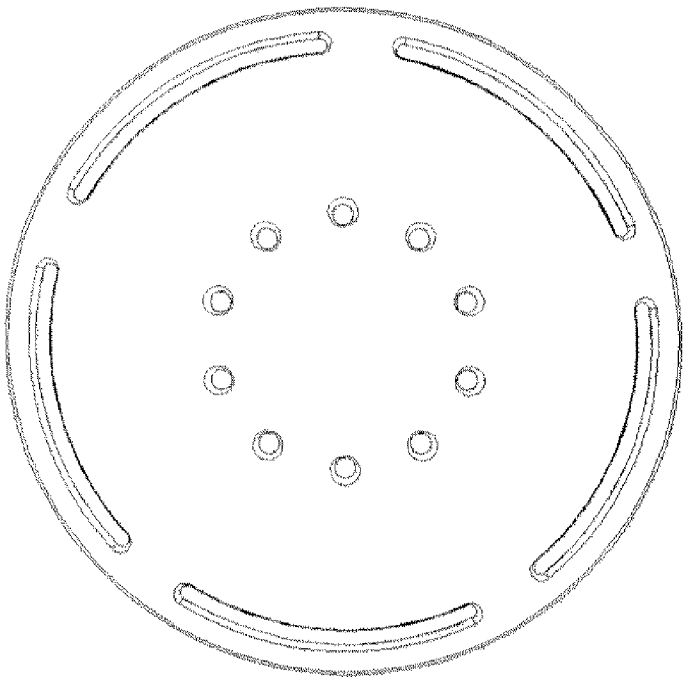
FIG. 13 is a diagram illustrating an example of a top piece shape and a pattern that can be provided on the top piece in accordance with one embodiment of the invention.

As illustrated in these figures, various hole or cut-out patterns can be provided through the surface of top 104 to provide unique light and shadow effects. For example, the embodiment illustrated in FIG. 13 provides a series of arcuate cutouts about the periphery of the top and round cutouts formed in a circle about the axial center of the top. Thus, from a side view, the lighting effect can resemble that of a starship.

Figure 14:
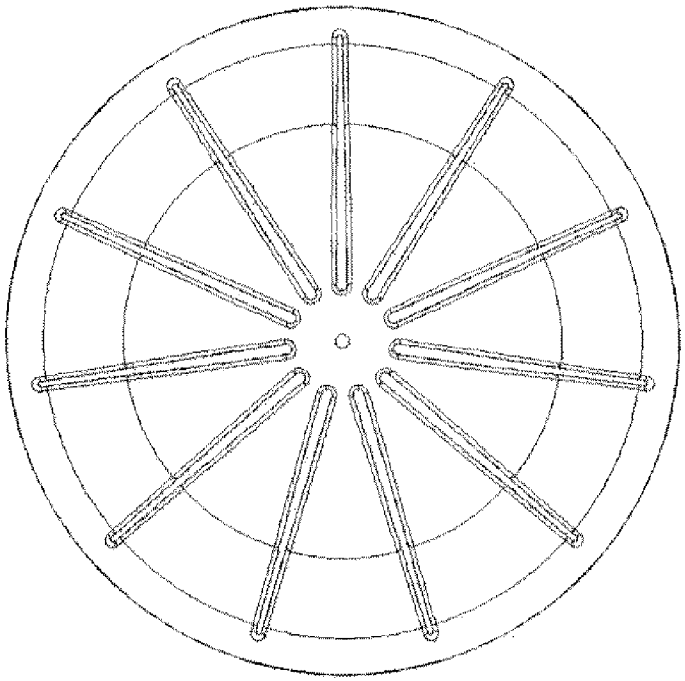
FIG. 14 is a diagram illustrating an example of a top piece shape and a pattern that can be provided on the top piece in accordance with one embodiment of the invention.
Figure 16:
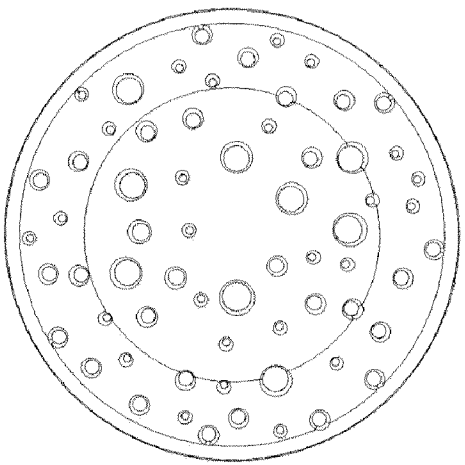
FIG. 16 is a diagram illustrating an example of a top piece shape and a pattern that can be provided on the top piece in accordance with one embodiment of the invention.
Figure 15:
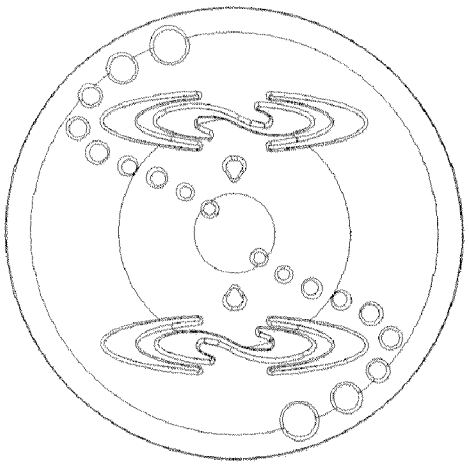
FIG. 15 is a diagram illustrating an example of a top piece shape and a pattern that can be provided on the top piece in accordance with one embodiment of the invention.

Illustrated in FIG. 14 is an example of a top shape and corresponding cutouts that resemble a sea urchin. Illustrated in FIG. 15 is a series of cutouts providing a swirl-like design. Illustrated in FIG. 16 is a series of cutouts comprising a plurality of relatively circular holes of various diameters suggesting a starry night.

Figure 17:
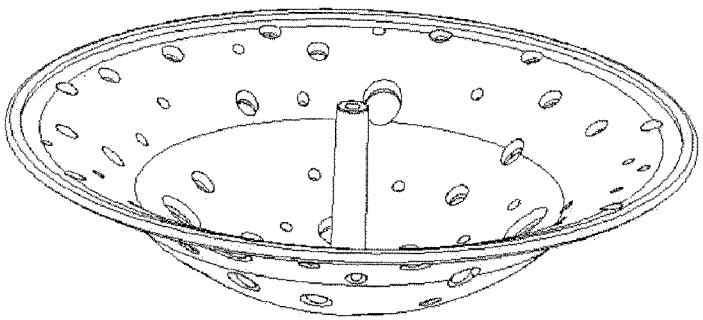
FIG. 17 is a diagram illustrating an undersurface of a top having a single mounting post extending from the center thereof configured for insertion into a recess in accordance with one embodiment of the invention.

FIG. 17 illustrates an undersurface of a top 104 having a single mounting post extending from the center thereof configured for insertion into a recess 144.

Figure 19:
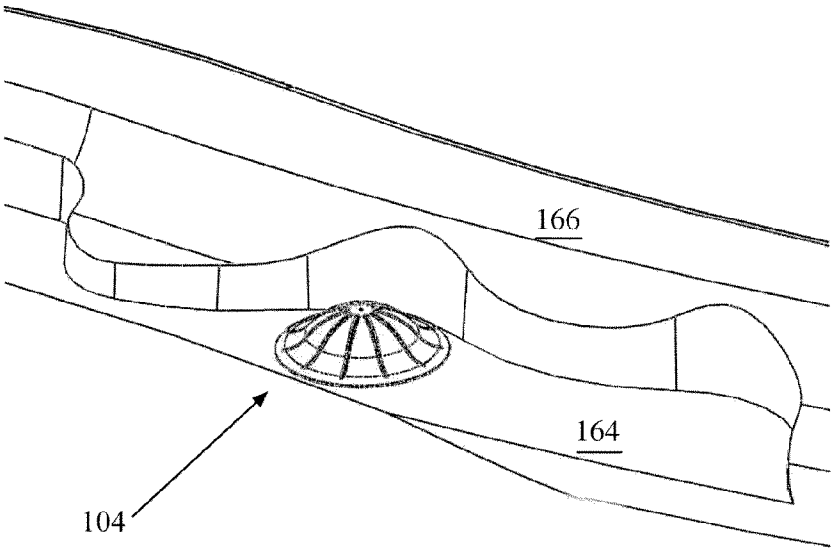
FIG. 19 is an ISO view of a configuration of a light assembly mounted in a recess.
Figure 18:
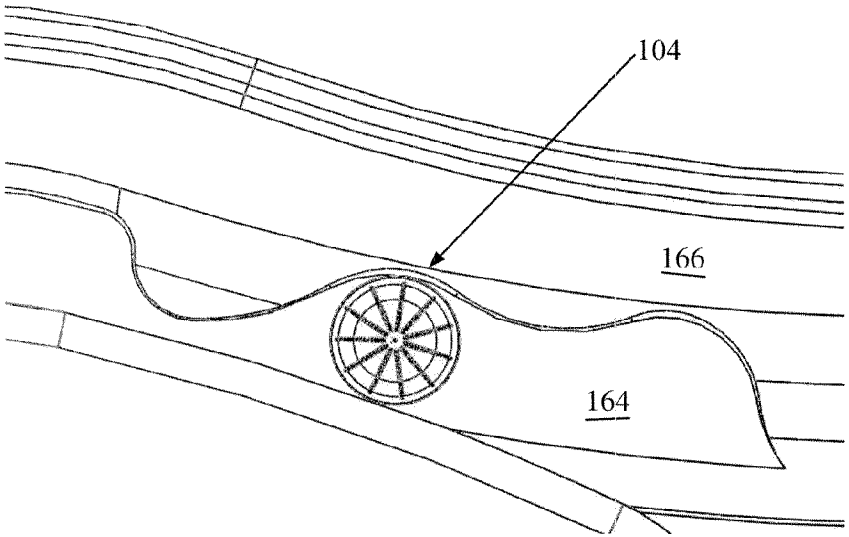
FIG. 18 is a diagram illustrating a top view of an installed light fixture in accordance with one embodiment of the invention.

FIG. 18 is a diagram illustrating a top view of an installed light assembly in accordance with one embodiment of the invention. Referring now to FIG. 18, illustrated is the exposed top piece 104 mounted in a recess area 164 of spa bar top 166. Similarly, FIG. 19 is an ISO view of a similar configuration of a light assembly mounted in a recess 164 of a spa bar top 166.

In one embodiment, the top piece can be implemented to provide a high level of aesthetics even when the lighting system is not in use. Thus, in one embodiment, the top piece can be configured to accent existing spa elements and can be adapted to current designs.

The lighting system in accordance with the present invention can be implemented to provide advantages over traditional lighting systems. For example, embodiments can be implemented to provide ease of upgrade, replacement, and after market changes. In one embodiment, the lighting assembly can be implemented in a small footprint to make it easy to blend into existing spa designs.

As stated above, in one embodiment, fixture 108 is made using silicone. The use of silicone can provide advantages over hard acrylic in many ways. For example, silicone can provide a more uniform lighting effect without hot spots and can also mask the source of light in a manner that is more desirable over acrylic designs. The silicone part can also provide a longer lasting water tight seal as well as seal the light source better than rigid acrylic. As such, the invention can be implemented without the need for additional sealants.

While various embodiments of the present invention have been described above, it should be understood that they have been presented by way of example only, and not of limitation. Likewise, the various diagrams may depict an example configuration for the invention, which is done to aid in understanding the features and functionality that can be included in the invention. The invention is not restricted to the illustrated examples or configurations, but the desired features can be implemented using a variety of alternative configurations.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; "a" or "an" means "at least one" or "one or more" and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent.

Additionally, the various embodiments set forth herein are described in terms of exemplary diagrams. As will become apparent to one of ordinary skill in the art after reading this document, the illustrated embodiments and their various alternatives can be implemented without confinement to the illustrated examples.

The invention claimed is:

1. A light fixture for a water containment vessel comprising:

a stem having a first end and a second end and sized to fit through an aperture in a wall of a water containment vessel;

a base extending from the first end of the stem and having a socket therein sized to accept a light source, wherein at least a portion of the base proximate the stem has a diameter larger than that of the stem; and a flange extending from the second end of the stem and having a mounting fixture configured to accept a light top.

2. The light fixture of claim 1, wherein the base is configured to be inserted in an aperture of a water containment vessel, such that a groove created at the stem between the base and the flange engages the wall of the water containment vessel, and wherein a light emitted from a light source disposed in the socket is diffused by the flange.

3. The light fixture of claim 1, wherein the light fixture is constructed of silicone.

4. The light fixture of claim 1, further comprising a light top configured to be removably mounted to the mounting fixture.

5. The fixture of claim 4, wherein the light top comprises a plurality of apertures.

6. The light fixture of claim 4, wherein the light top comprises a pavilion having plurality of apertures and a mounting apparatus disposed thereon configured to mate with the mounting fixture.

7. The light fixture of claim 1, wherein the wall comprises a side wall, top wall, bottom wall, seating surface, or bar top.

8. The light fixture of claim 1, wherein the mounting fixture is a recess sized to accept a post on the light top.

9. The light fixture of claim 1, wherein the vessel is a pool, spa, fountain, or tub.

10. A light assembly for a water containment vessel comprising:

a removable light assembly having a light source at a proximal end and an electrical connector at a distal end;

a fixture comprising a stem having a first end and a second end and sized to fit through an aperture in a wall of a water containment vessel;

a base extending from the first end of the stem and having a socket therein sized to accept a lead assembly, wherein at least a portion of the base proximate the stem has a diameter larger than that of the stem; and a flange extending from the second end of the stem and having a mounting fixture;

a light top having a mounting piece configured to removably mate with the mounting fixture of the flange.

11. The light assembly of claim 10, wherein the base is configured to be inserted in an aperture of a water containment vessel, such that a groove created at the stem between the base and the flange engages the wall of the water containment vessel, and wherein a light emitted from the light source disposed in the socket is diffused by the flange.

12. The light assembly of claim 10, wherein the light fixture is constructed of silicone.

13. The light assembly of claim 10, wherein the wall comprises a side wall, top wall, bottom wall, seating surface, or bar top.

14. The light assembly of claim 10, wherein the light top comprises a plurality of apertures.

15. The light assembly of claim 10, wherein the light top comprises a pavilion having plurality of apertures and a mounting apparatus disposed thereon configured to mate with the mounting fixture.

16. The light assembly of claim 10, wherein the vessel is a pool, spa, fountain, or tub.

17. An apparatus comprising:

a vessel for holding water, the vessel having at least one wall having an interior surface and an exterior surface;

an aperture in the wall of the vessel;

a fixture mounted in the aperture and comprising:

a stem, extending through the aperture and having a first end and a second end;

a base extending from the first end of the stem, having a socket therein sized to accept a light source; and a flange extending from the second end of the stem and having a mounting fixture, wherein the flange is configured to diffuse light; and a light top removably secured to the flange at the mounting fixture.

18. The apparatus of claim 17, wherein the base is configured to be inserted in an aperture of a water containment vessel, such that a groove created at the stem between the base and the flange engages the wall of the water containment vessel.

19. The apparatus of claim 17, wherein the fixture is constructed of silicone.

20. The apparatus of claim 17, wherein the wall comprises a side wall, top wall, bottom wall, seating surface, or bar top.

21. The apparatus of claim 17, wherein the light top comprises a plurality of apertures.

22. The apparatus of claim 17, wherein the light top comprises a pavilion having plurality of apertures and a mounting apparatus disposed thereon configured to mate with the mounting fixture.

23. The apparatus of claim 17, wherein the vessel is a pool, spa, fountain, or tub.

* * * * *